United States Patent [19]

Fastner et al.

[11] 3,935,895

[45] Feb. 3, 1976

[54] CONTINUOUS STEEL CASTING METHOD

[75] Inventors: Thorwald Fastner; Alois Niedermayr; Ernst Bachner; Herbert Bumberger, all of Linz, Austria

[73] Assignee: Vereinigte Osterreichische Eisen- und Stahlwerke-Alpine Montan Aktiengesellschaft, Linz, Austria

[22] Filed: June 3, 1974

[21] Appl. No.: 476,066

[30] Foreign Application Priority Data

June 14, 1973 Austria ..... 5222/73

[52] U.S. Cl. ..... 164/56; 164/82; 164/66; 164/259; 164/281

[51] Int. Cl.² ..... B22D 27/18; B22D 11/10

[58] Field of Search ..... 164/55, 56, 66, 82, 259, 164/281

[56] References Cited

UNITED STATES PATENTS

| | | | |
|---|---|---|---|
| 3,465,811 | 9/1969 | DeCastelet | 164/281 |
| 3,502,249 | 3/1970 | Wagstaff | 222/544 |
| 3,587,719 | 6/1971 | Schrewe et al. | 164/82 X |
| 3,642,052 | 2/1972 | Schrewe et al. | 164/55 |
| 3,648,761 | 3/1972 | Speith et al. | 164/281 |
| 3,685,986 | 8/1972 | Rutes et al. | 164/55 X |
| 3,698,466 | 10/1972 | Vogt et al. | 164/55 |
| 3,886,992 | 6/1975 | Moos et al. | 164/66 X |
| 3,888,294 | 6/1975 | Fastner et al. | 164/82 X |

FOREIGN PATENTS OR APPLICATIONS

| | | | |
|---|---|---|---|
| 1,425,163 | 12/1965 | France | 164/55 |
| 2,011,923 | 3/1970 | France | 164/281 |

*Primary Examiner*—Ronald J. Shore
*Attorney, Agent, or Firm*—Brumbaugh, Graves, Donohue & Raymond

[57] ABSTRACT

The present invention relates to a continuous steel casting method for a casting capacity of more than 1.5 metric tons of steel per minute. In this method a vertically arranged, substantially rectangular mold is used, into which at least one steel stream containing inert gas is passed through a casting tube below the surface of the casting level in the mold. The casting tube is provided with lateral downwardly inclined outlet openings, whose axes lie in a vertical plane running through the larger transverse axis of the mold. The axes of the lateral outlet openings run at an angle which depends upon the perpendicular distance of the axes from the narrow side of the mold. The inert gas is supplied in an amount of 1 to 15 Ncm³/kg steel, preferably 3 to 8 Ncm³/kg steel, to the steel stream over its entire cross section at the place of origin above the mold. The invention is of particular advantage for slabs wider than 800 mm of aluminum-containing steel.

12 Claims, 5 Drawing Figures

CONTINUOUS STEEL CASTING METHOD

BACKGROUND OF THE INVENTION

The invention relates to a continuous steel casting method for a casting capacity of more than 1.5 metric tons of steel per minute. The method uses a vertically arranged, substantially rectangular mold, into which at least one steel stream containing inert gas is passed through a casting tube below the surface of the casting level in the mold. The casting tube is provided with lateral outlet openings directed downward, whose axes lie in a vertical plane running through the bigger transverse axis of the mold.

It is known in continuous steel casting to provide a gas-permeable, ring-shaped disk of refractory material below the bottom opening of the tundish. Through this disk inert gas, preferably argon, is blown radially in the direction of the casting stream axis. Gas bubbles are carried downward together with the steel stream, then rise from the liquid phase in the continuous casting mold together with nonmetallic particles contained in the steel and wash these particles into a slag layer floating on the casting level in the mold (CONCAST NEWS, Vol. 10, 1/1971, p.4 and FIG. 11). The gas bubbles also cause a decrease of the penetration depth of the metal stream in the mold, which diminishes the danger of crack formation. The use of refractory, gas-permeable disks or other intermediate pieces has, however, the disadvantage that the gas has to be supplied under pressure. The control of the gas supply is also problematic and operationally unreliable due to the danger that the gas channels might become blocked. Moreover, a gas veil forms between the casting tube and the steel stream. Also it is not possible to supply the gas in such a way that its amount is distributed evenly over the entire stream cross section. It has therefore been proposed to provide in the tundish an outlet consisting of two parts, the outer part being formed by a highly gas-permeable material and the inner part by a less gas-permeable material, so that the inert gas can be carried both in the vertical direction upward, and radially and vertically in relation to the steel stream (German Utility Model No. 7.149.261). Course non-metallic inclusions are to be carried upward into the slag layer of the tundish before they enter the outlet, while the remaining gas quantity is carried downward through the casting tube, in order to brake or slow the casting stream. The construction of this known outlet is complicated, its production is expensive and its operational reliability is not sufficient. There is no guarantee that the gas supplied can be distributed evenly over the entire metal stream cross section. The same applies analogously to outlet stones i.e. refractory bricks that form part of the stopper for a ladle and have a passage for steel flow, having a lateral bore for the supply of a gas (German Utility Model No. 6,918,019).

In continuous steel casting it is essential that the strand be free from surface and inner cracks, since defects of this kind lead to material losses, because cracked strands have to be scarfed or even rejected. Since modern continuous casting plants are to work fully automatically, a further demand is that the safety precautions against breakthroughs of the molten steel through the solidified strand skin, be increased. The breakthroughs that hitherto occurred repeatedly in continuous casting plants led to severe damages of the plant and the production loss was considerable. However, practice has shown that these problems are relatively insignificant up to a casting capacity of 1.5 metric tons of steel per minute. If, however, one increases the casting capacity to more than 1.5 metric tons of steel per minute, it becomes apparent that the hitherto known technology is no longer sufficient. In rapid casting plants for slabs having a thickness of 150 to 250 mm and a width of 800 to 2500 mm and more, the crack formation and the possibility of breakthroughs increases rapidly, as the casting velocity rises, because the steel flow causes cavitations in the range of the solidified strand skin, which are all the more critical, the thinner the strand skin. As is known, the thickness of the strand skin decreases, as the casting capacity increases. The steel flow in the liquid phase of the strand is substantially determined by the direction of the axes of the lateral openings of the casting tube. Normally refractory casting tubes having a closed bottom and two lateral openings inclined downward and directed toward the narrow sides of the mold are used. When the casting velocity is high, mainly edge cracks and breakthroughs in the range of the strand edges occur. If one casts with a casting stream directed exclusively vertically downward, longitudinal cracks at the broad side of the slabs may occur in that range, where the flow is strongest. Moreover, non-metallic inclusions are carried to a great depth in the liquid phase, since they have no opportunity to rise and to get into the slag floating on the surface of the molten steel (casting level). If in a casting tube having a closed bottom, the lateral outlets are directed steeply or perpendicularly upward, at a high casting velocity the casting level in the mold is agitated too strongly, which renders the slag practice in the mold more difficult.

SUMMARY OF THE INVENTION

It is an object of the invention to overcome these difficulties in the casting of steel slabs by means of rapid or high-capacity casting machines and to provide a method, in which slabs having a width of more than 800 mm can be cast at a capacity of more than 1.5 metric tons of steel per minute without cracks occurring and using simple and well proven operational facilities. These slabs are to be low in non-metallic inclusions and, furthermore, the danger of breakthroughs below the mold is to be reduced.

According to the invention this object is achieved in a continuous steel casting method of the above described type in that a casting tube is used, in which the axes of the lateral outlet openings run at an angle ($\alpha$) dependent upon their perpendicular distance from the narrow side of the mold. This angle is 20° to 50°, when the perpendicular distance is 40 to 120 cm. The inert gas is supplied according to the invention in the amount of 1 to 15 $Ncm^3/kg$ steel, preferably 3 to 8 $Ncm^3/kg$ steel, to the steel stream over its entire cross section at the place of origin above the mold.

In order to achieve an optimum distribution of the inert gas over the entire cross section of the steel stream, the inert gas is, according to a further feature of the invention, supplied coaxially to the steel stream.

It is preferable that the inert gas be supplied through a refractory tube whose outlet is adjustable to particular distance above the bottom of a tundish, in which the casting tube is secured. This distance is preferably equal to or smaller than the diameter of the casting tube.

One can, however, also use a refractory tube for the gas supply, whose outer diameter is smaller than the inner diameter of the casting tube and whose outlet is adjustable to a distance below the bottom of a tundish, in which the casting tube is secured. This distance likewise is preferably equal to or smaller than the diameter of the casting tube.

The invention also comprises the use of a suitable slag or slag powder which is applied upon the casting level in the mold. This slag, which acts to receive the non-metallic particles from the steel, in particle aluminum-containing steel, is easily meltable, produced preferably synthetically and has the following composition:

20 to 50 percent fluxing agents of the group $CaF_2$, $Na_2O$, $K_2O$ and $B_2O_3$,
20 to 40 percent $SiO_2$,
25 to 40 percent CaO,
less than 5 percent $Al_2O_3$ and
0 to 10 percent oxides of iron, manganese and magnesium.

Particularly advantageous is the use of a slag having the following reference analysis:

about 12 percent $CaF_2$,
about 8 percent $Na_2O + K_2O$,
about 10 percent $B_2O_3$,
about 30 percent $SiO_2$,
about 30 percent CaO,
less than about 2 percent $Al_2O_3$,
about 4 percent FeO and
about 4 percent C.

BRIEF DESCRIPTION OF THE DRAWINGS

Further features and details of the invention will now be illustrated by way of examples with reference to the accompanying drawings in which.

DESCRIPTION OF EXEMPLARY EMBODIMENTS

Figure 1:
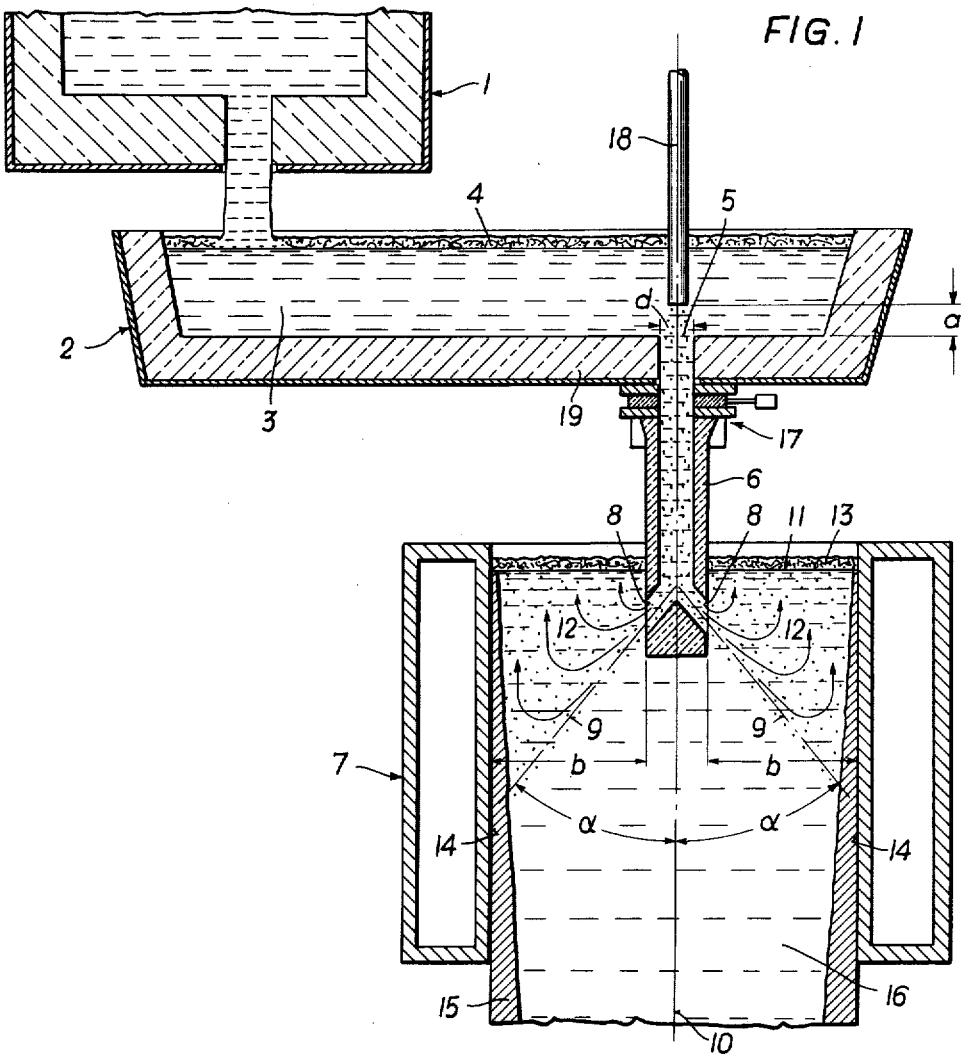
FIG. 1 is a vertical section through the upper part of a continuous steel casting plant with a casting tube (schematically illustrated) that is to be used according to the invention.

In FIG. 1, 1 denotes a pouring ladle, from which the steel flows continuously into a refractorily lined tundish 2, where a liquid phase 3 forms, which is protected against the influence of the atmosphere by a slag layer 4. Reference number 5 denotes a bottom opening with the diameter *d*, through which the steel flows into a refractory casting tube 6 and from there into a water-cooled straight vertically arranged oscillating mold 7. The casting tube 6 has a closed bottom and two lateral openings 8 lying opposite each other and being directed downward. The axes 9 of the openings enclose an acute angle $\alpha$ with the casting tube axis or the vertical mold axis 10. Reference number 11 denotes the casting level in the mold 7 and reference number 12 indicates the flow direction of the steel below the casting level that is covered by a slag layer 13. The walls 14 are the narrow sides of the rectangular slab mold. The axes 9 of the casting tube lie in a vertical plane laid through the bigger transverse axis of the mold, which plane corresponds to the plane of the drawing. The solidified skin 15 of the cast strand has a liquid core 16. Below the mold 7 rollers (not illustrated) for supporting and guiding the strand and cooling devices (not illustrated) for the secondary cooling of the strand are provided. Below the tundish 2 a sliding closure 17 can be provided, as known per se, to which the casting tube 6 is secured. Above the bottom opening 5 a refractory tube 18 is brought into position, through which tube an inert gas, e.g. argon, is supplied coaxially to the origin of the casting stream and is evenly distributed over the entire cross section of the stream. The outlet of the tube 18 is arranged at a distance *a* above the upper edge of the bottom opening 5, so that the brake effect of the gas occurs over the longest length possible of the casting stream. The distance *a* should preferably not be bigger than the diameter *d*, so that the gas is sucked in practically without pressure by the steel flow in the range of the bottom opening 5. If *a* is substantially bigger than *d*, the gas must be blown into the liquid steel phase under pressure, so that the entire gas quantity is passed through the casting tube 6 into the mold 7, i.e. so that it becomes fully effective. It is advantageous to supply 3 to 8 $Ncm^3$ of gas per kg of steel, where $Ncm^3$ means a cubic centimeter of gas at normal volume, i.e. the volume at 0°C and 760 mm Hg. If the gas quantity falls below 1 $Ncm^3$ per kg of steel, cracks may occur in the slabs and at a gas quantity of more than 15 $Ncm^3$ per kg steel the casting level 11 would bubble too strongly in the mold 7 thus disturbing the slag layer 13 and reducing its effectiveness. The tube 18 is liftable and lowerable in relation to the bottom 19 of the tundish 2, so that optimum conditions for the gas supply and gas distribution during operation can easily be adjusted, or adapted to each casting capacity.

Figure 2:
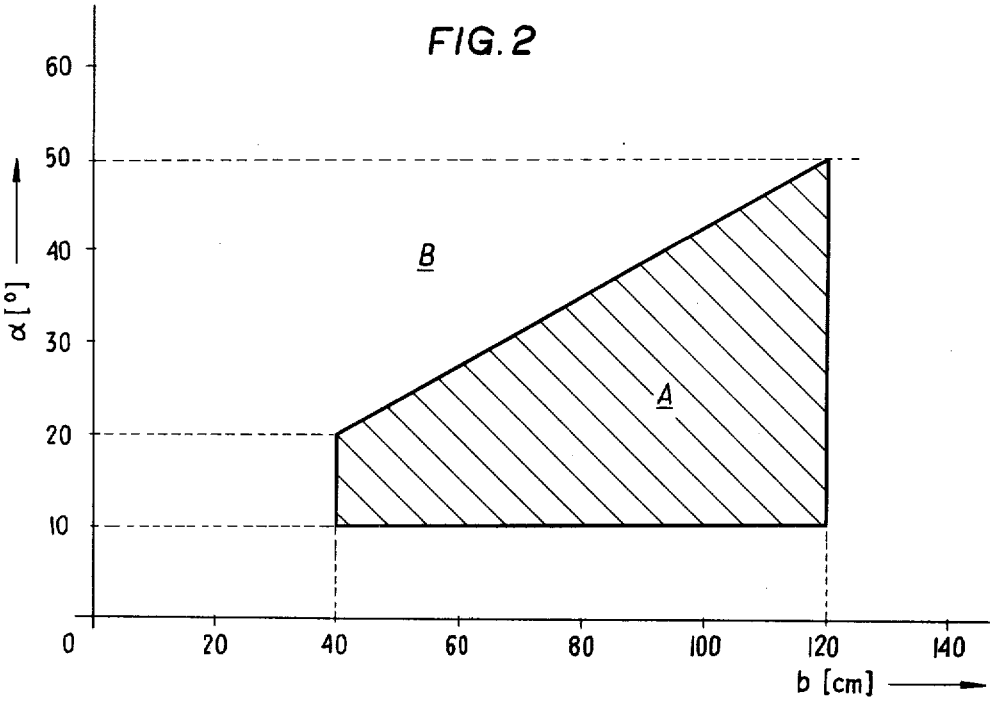
FIG. 2 is a graph which shows the characteristic correlation between the inclination angle of the axes of the lateral casting tube openings and their perpendicular distance *b* from the narrow side of the mold.

From the graph in FIG. 2 it is evident that the method may advantageously be applied for rectangular molds whose larger transverse axis is bigger than 80 cm, i.e. the perpendicular distance *b* of the lateral openings 8 of the casting tube 6 from the walls 14 is to measure at least 40 cm. In such a case the acute angle $\alpha$ between the vertical mold axis 10 - the axis of the casting stream or of the casting tube - may lie in the range of 10° to 20°. When *b* increases, e.g. up to 120 cm, which corresponds to a length of the larger transverse axis of the mold of more than 240 cm $\alpha$ may increase up to a maximum of 50°. Operational conditions according to the invention are given, when the values for $\alpha$ lie in field A. When the angle $\alpha$ lies in field B of FIG. 2, one has to reckon with cracked slabs and with the danger of a steel breakthrough below the mold. Also the possibility of crack formation and the frequency of the breakthroughs increase as the casting capacity increases. It is a feature of the invention that the above mentioned correlation between the angle $\alpha$ and the perpendicular distance *b* in combination with the coaxial gas supply is maintained at the largest possible distance from the mold, i.e. at the place of origin of the casting stream, in order to produce steel strands of top quality in high-capacity casting plants with a casting output of more than 1.5 metric tons of steel per minute.

After the steel leaves the casting tube non-metallic particles in the steel are washed upward into the slag layer 13 by gas bubbles carried along in the steel stream, which are then rising, and these particles are then received by the slag layer. The inert gas used may also be nitrogen instead of argon.

Figure 3:
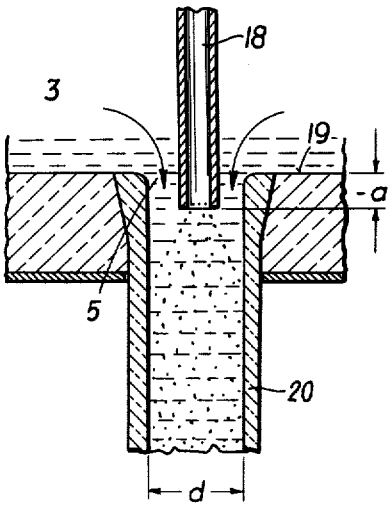
FIG. 3 is part of FIG. 1 and shows a different arrangement of the refractory casting tube for the gas supply.

FIG. 3 illustrates another embodiment of the invention, in which the inner diameter *d* of the casting tube 20 is much bigger than the outer diameter of the tube 18 for the gas supply, so that an annular gap, in which the flow of the metal is great, is formed at the bottom opening 5. Thereby a thorough mixing of steel and gas is achieved. The outlet of the tube 18 lies beneath the bottom area 19 at a distance $-a$, wherein $-a$ is to be equal to or smaller than *d*.

Figure 4:
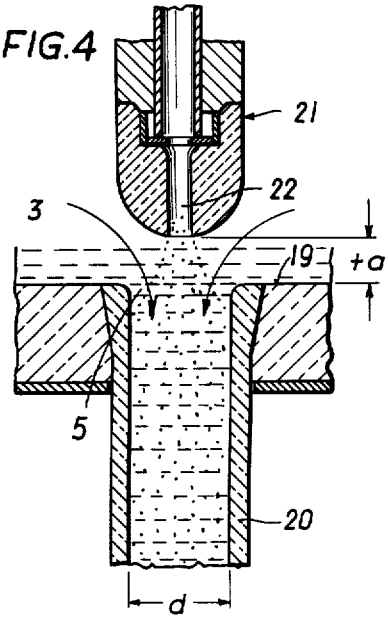
FIG. 4 is an illustration similar to FIG. 3 and shows a further embodiment of the invention.

FIG. 4 shows a further embodiment, in which for closing the casting tube 20 or for regulating the steel supply into the mold, a refractory plug 21 with an axial bore 22 for the gas supply is provided. The mouth of the bore 22 is arranged above the bottom area 19 at a distance $+a$, so that, when *a* is not bigger than *d*, the gas may be sucked in without pressure through the shaft of the plug.

Figure 5:
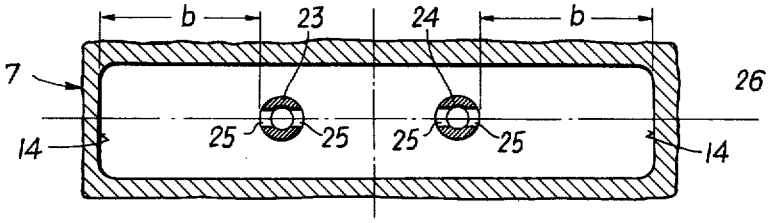
FIG. 5 is a horizontal section through a rectangular slab mold of particularly great width, in which two casting tubes are arranged side by side.

According to the embodiment illustrated in FIG. 5 two casting tubes (23 and 24), whose openings are denoted with 25, are arranged in an extremely wide mold. The axes of the lateral openings 25 lie in a vertical plane laid through the larger transverse axis 26 of the mold, and the inclination of these axes in relation to the vertical axis 10 of the mold (FIG. 1) is determined according to the graph in FIG. 2 in correspondence with the smallest perpendicular distance *b* of the lateral openings 25 from the narrow side 14 of the mold 7.

The invention may be applied in continuous casting of all types of steel, yet its use is of particular advantage for wide slabs of aluminum-containing steel. In particular the method of the invention is to be recommended for aluminum-killed deep-drawing steels having the following composition:

C 0.03 to 0.07 percent
Si traces
Mn 0.30 to 0.45 percent
P max. 0.020 percent
S max. 0.020 percent and
Al 0.020 to 0.060 percent, which steels are destined for the production of cold rolled sheets with maximum surface quality.

We claim:

1. In a continuous steel casting method for a casting capacity of more than 1.5 metric tons of steel per minute, wherein at least one stream of molten steel is formed and cast into a vertically arranged, substantially rectangular mold, having a larger transverse axis and a smaller transverse axis, through a casting tube having a certain clear cross section and extending to below the level of molten steel in the mold, said casting tube having lateral, downwardly directed outlet openings whose axes lie in a vertical plane running through the larger transverse axis of the mold, the outlet openings having a certain perpendicular distance from a narrow side of the mold, and wherein said at least one stream of molten steel contains inert gas, the improvement comprising:

casting the at least one stream of molten steel, having a certain cross section, through a casting tube, in which the axes of the lateral outlet openings run at an angle dependent upon the perpendicular distance of said axes from the narrow side of the mold, this angle amounting maximally to 20° when the perpendicular distance is 40 cm and the maximum angle increasing linearly with respect to an increase in distance up to 50° at a distance of 120 cm; and supplying the said inert gas to the said at least one stream of molten steel in an amount in the range of 1 to 15 $Ncm^3$/kg steel over the entire cross section of the stream of molten steel at the place of origin of said at least one stream of molten steel above the mold.

2. A method according to claim 1, wherein the inert gas is supplied to the at least one stream of molten steel in an amount of 3 to 8 $Ncm^3$/kg steel.

3. A method according to claim 1, wherein the inert gas is supplied to the at least one stream of molten steel coaxially.

4. A method according to claim 1, wherein the at least one stream of molten steel is cast into the mold from a tundish, in whose bottom the casting tube is secured, and wherein the inert gas is supplied coaxially to the at least one stream of molten steel through a refractory tube, said refractory tube having an outlet adjustable at a certain distance above the bottom of the tundish.

5. A method according to claim 4, wherein said distance is substantially equal to the width of the casting tube.

6. A method according to claim 4, wherein said distance is somewhat smaller than the width of the casting tube.

7. A method according to claim 1, wherein at least one stream of molten steel is cast into the mold from a tundish, in whose bottom the casting tube is secured, and wherein the inert gas is supplied coaxially to the at least one stream of molten steel through a refractory tube, said refractory tube having an outer cross section smaller than the inner cross section of the casting tube and an outlet adjustable at a certain distance below the bottom of the tundish.

8. A method according to claim 7, wherein said distance is substantially equal to the width of the casting tube.

9. A method according to claim 7, wherein said distance is smaller than the width of the casting tube.

10. A method according to claim 1, wherein, for receiving non-metallic particles from the steel, in particular aluminum-containing steel, an easily melting slag having the following composition is used in the mold: 20 to 50% fluxing agents of the group $CaF_2$, $Na_2O$, $K_2O$ and $B_2O_3$,

20 to 40% $SiO_2$,
25 to 40% CaO,
less than 5% $Al_2O_3$ and
0 to 10% oxides of iron, manganese and magnesium.

11. A method according to claim 10, wherein the slag is a synthetically produced slag.

12. A method according to claim 10, wherein the slag has the following reference analysis:

about 12% $CaF_2$,
about 8% $Na_2O + K_2O$,
about 10% $B_2O_3$,
about 30% $SiO_2$,
about 30% CaO,
less than about 2% $Al_2O_3$,
about 4% FeO and
about 4% C.

* * * * *